US006997964B1

(12) United States Patent
Marelli

(10) Patent No.: US 6,997,964 B1
(45) Date of Patent: Feb. 14, 2006

(54) DIESEL ENGINE FUEL IN MICROEMULSION FORM AND METHOD FOR PREPARING IT

(76) Inventor: Ernesto Marelli, Via Buttero, 20, 23857 Olgiate Molgora (IT)

( * ) Notice: Subject to any disclaimer, the term of this patent is extended or adjusted under 35 U.S.C. 154(b) by 0 days.

(21) Appl. No.: 09/709,581

(22) Filed: Nov. 13, 2000

(30) Foreign Application Priority Data

Nov. 16, 1999 (IT) ..... MI99A2393

(51) Int. Cl.
*C10L 1/18* (2006.01)

(52) U.S. Cl. ..... 44/301; 44/302; 44/308; 44/388

(58) Field of Classification Search ..... 44/301, 44/302, 308, 388
See application file for complete search history.

(56) References Cited

U.S. PATENT DOCUMENTS 3,615,290 A * 10/1971 Nixon ..... 44/301
3,876,391 A * 4/1975 Mc Coy et al. ..... 44/301
4,295,859 A * 10/1981 Boehmke ..... 44/301
4,477,258 A * 10/1984 Lepain ..... 44/302
5,743,922 A 4/1998 Peter-Hoblyn et al.
6,068,670 A * 5/2000 Haupais et al. ..... 44/301
6,280,485 B1 * 8/2001 Daly et al. ..... 44/301

FOREIGN PATENT DOCUMENTS

WO 93 18117 9/1993
WO 99 32585 7/1999

* cited by examiner

*Primary Examiner*—Cephia D. Toomer
(74) *Attorney, Agent, or Firm*—Guido Modiano; Albert Josif; Daniel O'Byrne

(57) ABSTRACT

A fuel, particularly for Diesel engines, in microemulsion form, comprising a liquid fuel, an emulsifier and an emulsive agent, the emulsive agent having an HLB value higher than 9. The invention also relates to a method for preparing a fuel, particularly for Diesel engines, in microemulsion form, which comprises the mixing of a liquid fuel, particularly a liquid fuel for Diesel engines, an emulsifier and an emulsive agent, the emulsive agent having an HLB value of more than 9, and to a fuel which can be obtained by means of the method.

9 Claims, No Drawings

DIESEL ENGINE FUEL IN MICROEMULSION FORM AND METHOD FOR PREPARING IT

BACKGROUND OF THE INVENTION

The present invention relates to a fuel in microemulsion form, particularly for supplying Diesel engines, and to a method for preparing it.

Emulsions or microemulsions of petroleum products and water in which particular surfactants or mixtures of surfactants are used are known in the art.

For example, U.S. Pat. No. 3,876,391 discloses microemulsions of hydrocarbon products with water in which a mixture of surfactants is used which is constituted by a first surfactant which is soluble in the oil phase and a second surfactant which is soluble in the aqueous phase, to which a further water-soluble additive, for example an amide, an alkanolamine, a polyamine or an aldehyde, is added.

U.S. Pat. No. 4,465,494 discloses microemulsions of liquid fuels and water which contain an alcohol or an amine and, as surfactant, a salt of an alkylphenoxyalkanoic acid.

A fuel emulsified with water is disclosed in EP-630,398 and is obtained by mixing the compounds in a static mixer in particular pressure and temperature conditions in the presence of a mixture of surfactants constituted by sorbitan oleate, a polyalkylene glycol and an alkylphenol ethoxylate.

In general, the use of surfactants or other additives such as the ones mentioned above can entail problems both because they can be inherently corrosive with respect to the devices with which they come into contact and because toxic by-products can form during combustion.

Moreover, on the basis of the experience of the Applicant, emulsions of liquid fuels and water prepared according to conventional methods by adding appropriate surfactants generally entail stability problems even in optimum storage conditions, so that after a certain time an at least partial separation of the phases is observed which entails many drawbacks during the combustion process owing to the non-uniformity of the supplied fuel.

EP-372,353 by the same Applicant discloses a stabilized emulsion of a fuel, particularly a fuel for Diesel engines, and water, with the addition of a product which acts as a lubricant and antifreeze, for example sorbitol monoleate. The stabilized emulsions of fuel are prepared by using a turbine-effect emulsifier such as the one disclosed in EP-124,061 in the name of this same Applicant.

Applicant has noted that in some cases, particularly in case of use of low-density fuels, the preparation of the fuels as disclosed in EP-124,061 and EP-372,353 entails a relatively high energy expenditure and a reduction in the productivity of the system, if one seeks high productivity and stability.

A method with improved efficiency for forming the emulsion of a fuel is disclosed in co-pending EPA No. 00121331.3 and corresponding co-pending U.S. application Ser. No. 09/684,649 filed on Oct. 10, 2000 by the same Applicant, included herein by reference. This method requires the use of an apparatus having a particular geometry.

The above applications disclose an apparatus and a method for forming stabilized atomized microemulsions from different liquids which are normally immiscible; the apparatus comprises a primary chamber and a sequence of at least two cavitation chambers arranged in succession, means for feeding primary and secondary fluids into the primary chamber, and means for the exit of the formed microemulsion from the last cavitation chamber, the primary chamber and the cavitation chambers being fluid-connected to each other by way of fluid passage means which are adapted to produce a velocity of the fluids, during passage through the passage means, which gradually increases from the primary chamber toward the last cavitation chamber. The method according to the above applications comprises the stage of premixing the primary fluid with the secondary fluid, followed by the passage of the premix of fluids through a succession of steps of flow at a higher velocity alternated with steps of flow at a lower velocity, the higher flow velocities gradually increasing from the first higher-velocity step to the last higher-velocity step.

SUMMARY OF THE INVENTION

The aim of the present invention is to provide a fuel, particularly for Diesel engines, in microemulsion form which produces, in exhaust gases, a 97% reduction in the grade of smoke, a reduction of the carbon oxide content of more than 50%, a reduction of more than 1% in carbon dioxide, and a reduction in nitrogen oxides of more than 35–40% with respect to the conventional base fuel.

An object of the present invention is to provide a fuel in microemulsion form which is simple to prepare, for example by mixing the components with minimal agitation, without any need to follow a preferential order in adding the components.

Another object of the present invention is to provide a fuel in microemulsion form which poses no engine operation problems and can be stored in storage tanks in the same conditions as Diesel fuel.

Another object of the present invention is to provide a fuel for use in feeding Diesel engines, such as engines for medium-heavy transport, engines for heavy transport, marine engines, electric power generators and turbines and can also be used in civil heating applied to gas oil burners.

DETAILED DESCRIPTION OF THE INVENTION

This aim and these objects and other aims and objects which will become better apparent hereinafter from the following description are achieved by a fuel, particularly for Diesel engines, in microemulsion form, which comprises a liquid fuel, an emulsifier or primary activating agent, an emulsive agent or secondary activating agent and water, said emulsive agent having a suitable HLB (Hydrophilic-Lipophilic Balance) value which is preferably higher than 9.

Preferably, the liquid fuel is a liquid fuel for Diesel engines, particularly Diesel fuel.

The Diesel fuel used to obtain the fuel according to the present invention can be Diesel fuel for automotive applications but also a Diesel fuel for different uses, including arctic Diesel fuel and winter Diesel fuel.

The emulsifier used to form the fuel according to the present invention can be a sorbitan monoleate and is preferably a sorbitan monoleate having the characteristics given in Table 1.

TABLE 1

| Sorbitan monoleate characteristics | |
|---|---|
| Appearance at 20° C. | Oily |
| Saponification number (mg KOH/g) | 145–165 |
| Color | light amber (Gardner 10 max) |
| Acidity index | 7 max |
| Odor | sweet, fatty |
| Hydroxyl index (mg KOH/g) | 190–215 |
| Evolution temperature/range | Decomposes |
| Melting point | −13° C. pouring temperature |
| Flammability point | >200° C. Pensky Martens method, closed cup |
| Self-ignition temperature | >200° C. |
| Non-explosive | |
| Density | 1.010–1.040 g/cm$^3$ at 25° C. |
| Can be dispersed in water, non-soluble | |
| pH 1% in water | neutral (approximately 7) |
| Viscosity | 970–1080 mPa.s at 25° C. |
| Acute toxicity | >5000 mg/kg (rat) |

As an alternative, in order to obtain the fuel according to the present invention it is possible to use other emulsifiers which are in any case still definable as sorbitan monoleate also of the hydroxystearate type, even with a saponification number and a hydroxyl number which are lower than the ones indicated in Table 1 and an acidity number which is higher than the one indicated in Table 1.

The inventor of the present invention has found that the presence of the emulsive agent is fundamental both when the preferred emulsifier as indicated in Table 1 is used and when another alternative emulsifier is used.

Preferably, the emulsive agent is constituted by nonylphenol ethoxylate, which can also be defined as polyethylene glycol isononyl phenyl ether or as isononyl phenol ethoxylate, nonylphenol polyglycol ether, alkylphenol polyglycol ether, even more preferably with the characteristics stated in Table 2.

TABLE 2

| characteristics of emulsive agent | |
|---|---|
| No. of moles of ethylene oxide | 6 |
| Physical appearance at 25° C. | clear colorless liquid |
| State transition | < approximately −10° C. - MPL 1001,1 |
| Turbidity point (10% in BDG at 25%) | 68 to 69° C. MPL 2001,0 |
| Hydroxyl index | 115 to 121 mg/KOH/g - MPL 1010,0 |
| Average relative molecular mass | 464 to 487 - calculated value |
| Free polyethylene glycols | >= approximately 3% by weight - MPL 2002,0 |
| pH (5%) | 5 to 7 - MPL 1007,0 |
| Water (Karl-Fisher) | > = approximately 0.5% by weight, calculated |
| Ash | > = approximately 0.2% by weight, calculated |
| HLB | 10.7, calculated |

The inventor of the present invention has found that a fundamental characteristic of the emulsive agent comprised in the fuel according to the present invention is the emulsive capacity in order to allow the integration of water at a high level.

The emulsive capacity required for the purposes of the present invention is achieved by emulsive agents with a calculated HLB higher than 9, preferably higher than 10,7 for better hydrophilic properties. HLB (hydrophilic-lipophilic balance) reflects the balance of the hydrophilic-lipophilic properties of the emulsive agent and is determined with conventional methods which are typical in the chemical production field.

The inventor of the present invention has found that such an HLB value is reached by a nonylphenol ethoxylate having the properties indicated in Table 2, and in particular with a number of ethylene oxide moles of no less than 6 (number of moles, i.e., amount of ethylene oxide material introduced in the manufacturing process).

The nonylphenol ethoxylate used to obtain the fuel according to the present invention preferably has the chemical formula $R—C_6H_4—(O—CH_2—CH)_nOH—>$, where $R=C_9H_{19}$ and n is approximately 6.

Even more preferred emulsive agents, also with reference to possible future statutory aspects, are non-ionic surfactants such as for example $C_{12}$ $C_{13}$ alcohol ethoxylate with an average of 8 moles of ethylene oxide, in particular having the following characteristics:

| | |
|---|---|
| Physical appearance at 25° C. | almost colorless turbid liquid |
| State transition at ° C. | 15–20 |
| Turbidity point ° C. | 57–59 |
| Number of hydroxyls mg KOH/gr | 99–107 |
| Average relative molecular mass | 524–567 |
| Free polyethylene glycols (% by weight) | ≦3 |
| pH (5%) | 5–7 |
| Water (Karl Fisher method) % | ≦0.5 |
| Ash % by weight | ≦0.2 |
| HLB | 12.8 |

Moreover, a preferable emulsive agent is a $C_{16}$ $C_{18}$ cetyl stearyl alcohol ethoxylate with 11 moles of ethylene oxide of the non-ionic type, which can be combined with anionic and cationic surfactants, for example having the following characteristics:

| | |
|---|---|
| Cetyl stearyl alcohol (fatty alcohol) | $C_{16}$ $C_{18}$-11 moles of ethylene oxide |
| pH sol. 3% | 5–7 |
| NaCl 10% turbidity point | 58–62° C. |
| Hydroxyl number | 69–75 mg KOH/g |
| Water content | ≦1% |
| Melting point | 37.5–39.5° C. |
| Acidity number | ≦1 |
| Relative density at 70° C. | 0.962–0.965 g/cm$^3$ |
| Solidification point | ≦35° C. |
| Flash point | ≦250° C. |
| Solubility | clear solution in water at 40° C.<br>partial solution in water at 20° C. |
| Appearance | solid |
| Color | whitish |
| Odor | almost non-existent (odorless) |

Also these "emulsive agents" can be introduced in the same ratios as those provided for nonylphenol ethoxylate, i.e., from 5 to 20 parts in 1000 parts of intact Diesel fuel.

The presence of the emulsive agent $C_{16}C_{18}$-11 moles of ethylene oxide; when the microemulsion is processed in particular through the EMDTS system provided with multiple reverse-flow coaxial turbines according to EPA No. 00121331.3 and to the corresponding co-pending US Application Ser. No. 09/684,649 filed on Oct. 10, 2000 by the same Applicant, allows to form stable microemulsions, such as environment-friendly fuels for Diesel engines, even with demineralized water up to 15% by weight of bio-vegetable fluids, such as for example biodiesel or methyl esters composed of rapeseed and sunflower oil which are commercially available and cannot be used in their natural state as fuels for Diesel engines since they cause seizure and produce bad odors.

The presence of emulsive agents such as $C_{12}C_{13}$ and $C_{16}C_{16\text{-}18}$ alcohols with 8 and 11 moles of ethylene oxide is therefore a significant help also in significantly reducing the "French-fries" odor that is typical of the combustion of a methyl ester in its natural state, in addition to more easily assisting the presence of an antifreeze such as monoethylene glycol, even at 3 to 6% with respect to the percentage of water; the presence of a biocide for "antibacterial protection" in order to provide "resistance to bacterial and fungal attack" is also helpful.

Preferably, the fuel in microemulsion form according to the present invention comprises, in parts per volume, for 1000 parts of conventional Diesel fuel, 13 to 17 parts of emulsifier, 5 to 20 parts of emulsive agent, and 100 to 145 parts of water.

The water used is preferably demineralized water, but it is also possible to use water from the water mains, preferably filtered and at a maximum temperature of 40–45° C.

The fuel according to the present invention can contain, preferably in an amount between 400 and 800 ppm, products based on polyisobutylene succinic anhydride and also specific biocide products.

The addition of products based on polyisobutylene succinic anhydride meets a possible requirement of improving the cetane number (owing to the presence of water) and also of giving better characteristics toward low temperatures. The biocides meet the optional need to avoid the formation of bacterial colonies due to the presence of the sorbitan monoleate and due to the natural bacterial presence in Diesel fuel containment tanks, which grows especially in hot climates (>27° C.)

The fuel according to the present invention can be obtained by mixing the components, i.e., conventional base fuel, preferably Diesel fuel, emulsifier, emulsive agent and water, with minimal agitation. The formation of the microemulsion is practically instantaneous and is revealed by an instantaneous change of color of the mixture of components, which becomes white. The instantaneous behavior is also an essential visual parameter for determining the result.

The microemulsion is formed even as easily as by placing the components in a container, even a bucket, and by performing minimal agitation. The microemulsion is characterized by microcells having dimensions substantially smaller than 0.15 $\mu$m.

The resulting microemulsion is stable even after centrifugation at over 35,000 m/s$^2$.

The preparation of the fuel according to the invention, which is termed GECAME-2, occurs substantially spontaneously or in any case with minimal agitation of the components, without the need for devices such as the turbine-effect emulsifier. However, for the sake of high productivity in a particular short time, the fuel according to the invention can be formed by using an apparatus such as the one disclosed in co-pending EPA No. 00121331.3 and corresponding co-pending U.S. application Ser. No. 09/684,649 filed on Oct. 10, 2000 by the same Application. The use of such a device is suggested merely owing to the fact that this system allow homogenization of large volumes substantially instantaneously with very low industrial costs.

The disclosures in Italian Patent Application No. MI99A002393 from which this application claims priority are incorporated herein by reference.

What is claimed is:

1. A fuel in microemulsion form, comprising a liquid fuel, an emulsifier and an emulsive agent, said emulsive agent having an HLB value higher than 9, wherein the liquid fuel comprises a bio-vegetable fluid selected from the group consisting of biodiesel and methyl esters of rapeseed oil and of sunflower oil, wherein said emulsive agent is $C_{12}$–$C_{13}$ alcohol ethoxylate.

2. The fuel according to claim 1, wherein said emulsifier is sorbitan monooleate.

3. The fuel according to claim 1, wherein said $C_{12}$–$C_{13}$ alcohol is ethoxylated on the average 8 moles of ethylene oxide.

4. The fuel according to claim 1, further comprising products based on polyisobutenyl succinic anhydride.

5. The fuel according to claim 1, further comprising biocide products.

6. The fuel according to claim 1, comprising in parts per volume, for 1000 parts of liquid fuel, 13 to 17 parts of emulsifier, 5 to 20 parts of emulsive agent and 100 to 145 parts of water.

7. A method for preparing a fuel in microemulsion form, comprising mixing a liquid fuel, an emulsifier and an emulsive agent, said emulsive agent having an HLB value of more than 9, in a system provided with multiple reverse-flow coaxial turbines.

8. A fuel in microemulsion form obtained by mixing of a liquid fuel, an emulsifier and an emulsive agent, said emulsive agent having an HLB value of more than 9, wherein the liquid fuel comprises a bio-vegetable fluid selected from the group consisting of biodiesel and methyl esters of rapeseed oil and of sunflower oil, wherein said emulsive agent is $C_{12}$–$C_{13}$ alcohol ethoxylate, in a system provided with multiple reverse-flow coaxial turbines.

9. The fuel according to claim 1, which does not dissociate in its components even when subjected to centrifugation up to values of more than 35.000 m/s$^2$.

* * * * *